US011437212B1

(12) United States Patent
Arciaga et al.

(10) Patent No.: US 11,437,212 B1
(45) Date of Patent: Sep. 6, 2022

(54) SURFACE MOUNT FUSE WITH SOLDER LINK AND DE-WETTING SUBSTRATE

(71) Applicant: Littelfuse, Inc., Chicago, IL (US)

(72) Inventors: Marko Arciaga, Batangas (PH); Gordon Todd Dietsch, Park Ridge, IL (US); Roel Santos Retardo, Batangas (PH); Deepak Nayar, Chicago, IL (US)

(73) Assignee: Littelfuse, Inc., Chicago, IL (US)

( * ) Notice: Subject to any disclaimer, the term of this patent is extended or adjusted under 35 U.S.C. 154(b) by 0 days.

(21) Appl. No.: 17/395,749

(22) Filed: Aug. 6, 2021

(51) Int. Cl.
*H01H 85/041* (2006.01)
*H01H 69/02* (2006.01)

(52) U.S. Cl.
CPC ..... *H01H 85/0411* (2013.01); *H01H 69/02* (2013.01); *H01H 2085/0414* (2013.01)

(58) Field of Classification Search
CPC .... H01H 85/0411; H01H 85/08; H01H 85/10; H01H 85/11; H01H 2085/0412; H01H 2085/0414
See application file for complete search history.

(56) References Cited

U.S. PATENT DOCUMENTS 4,608,548 A * 8/1986 Borzoni ..... H01H 85/0417 337/201
5,726,621 A * 3/1998 Whitney ..... H01H 85/0411 337/292
5,777,540 A * 7/1998 Dedert ..... H01H 85/046 257/665
7,106,165 B2 * 9/2006 Mukai ..... H01M 50/572 337/401
2007/0075822 A1 * 4/2007 Pachla ..... H01H 85/0411 337/297
2008/0191832 A1 * 8/2008 Tsai ..... H01H 85/0411 29/623
2014/0266565 A1 * 9/2014 Enriquez ..... H01H 85/143 337/297
2015/0009007 A1 * 1/2015 Enriquez ..... H01H 85/0411 337/290
2018/0315564 A1 * 11/2018 Sherrima ..... H01H 69/022
2020/0196442 A1 * 6/2020 Woodley ..... H01H 85/0241

FOREIGN PATENT DOCUMENTS

KR 102095225 B1 * 3/2020

OTHER PUBLICATIONS

Jang. KR102095225B1 translation (Year: 2020).*

* cited by examiner

*Primary Examiner* — Jacob R Crum
(74) *Attorney, Agent, or Firm* — KDB Firm PLLC

(57) ABSTRACT

A surface mount device chip fuse including a dielectric substrate, electrically conductive first and second upper terminals disposed on a top surface of the dielectric substrate and defining a gap therebetween, a fusible element formed of solder disposed on the top surface of the dielectric substrate, within the gap, bridging the first and second upper terminals, and electrically conductive first and second lower terminals disposed on a bottom surface of the dielectric substrate and electrically connected to the first and second upper terminals, respectively, wherein a material of the dielectric substrate exhibits a de-wetting characteristic relative to the solder from which the fusible element is formed.

8 Claims, 3 Drawing Sheets

SURFACE MOUNT FUSE WITH SOLDER LINK AND DE-WETTING SUBSTRATE

BACKGROUND

Field

The present disclosure relates generally to the field of circuit protection devices. More specifically, the present disclosure relates to a surface mount device chip fuse including a fusible element formed of solder disposed on a de-wetting substrate.

Description of Related Art

Fuses are commonly used as circuit protection devices and are typically installed between a source of electrical power and a component in an electrical circuit that is to be protected. A conventional surface mount device (SMD) chip fuse includes a fusible element disposed on a an electrically insulating substrate. The fusible element may extend between electrically conductive terminals located at opposing ends of the substrate. Upon the occurrence of a fault condition, such as an overcurrent condition, the fusible element melts or otherwise separates to interrupt the flow of electrical current through the fuse.

When the fusible element of a fuse separates as a result of an overcurrent condition, it is sometimes possible for an electrical arc to propagate through the air between the separated portions of the fusible element (e.g., through vaporized particulate of the melted fusible element). If not extinguished, this electrical arc may allow significant follow-on currents to flow to from a source of electrical power to a protected component in a circuit, resulting in damage to the protected component despite the physical opening of the fusible element.

It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

A surface mount device chip fuse in accordance with an exemplary embodiment of the present disclosure may include a dielectric substrate, electrically conductive first and second upper terminals disposed on a top surface of the dielectric substrate and defining a gap therebetween, a fusible element formed of solder disposed on the top surface of the dielectric substrate, within the gap, bridging the first and second upper terminals, and electrically conductive first and second lower terminals disposed on a bottom surface of the dielectric substrate and electrically connected to the first and second upper terminals, respectively, wherein a material of the dielectric substrate exhibits a de-wetting characteristic relative to the solder from which the fusible element is formed.

DETAILED DESCRIPTION

Exemplary embodiments of a surface mount device (SMD) chip fuse in accordance with the present disclosure will now be described more fully hereinafter with reference to the accompanying drawings. The SMD chip fuse may, however, be embodied in many different forms and should not be construed as being limited to the embodiments set forth herein. Rather, these embodiments are provided so that this disclosure will convey certain exemplary aspects of the SMD chip fuse to those skilled in the art.

Figure 1:
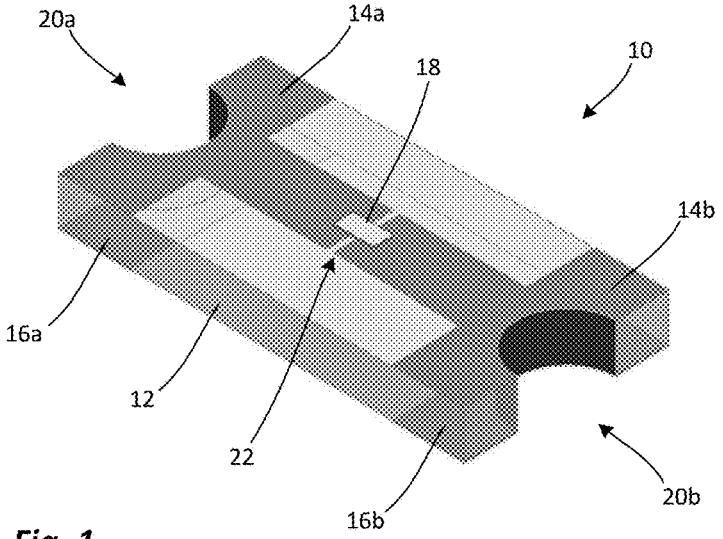
FIG. 1 is a perspective view illustrating a surface mount device chip fuse in accordance with an exemplary embodiment of the present disclosure.

Referring to FIG. 1, a perspective view illustrating a SMD chip fuse 10 in accordance with an exemplary embodiment of the present disclosure is shown. The SMD chip fuse 10 may generally include a dielectric substrate 12, electrically conductive first and second upper terminals 14*a*, 14*b*, electrically conductive first and second lower terminals 16*a*, 16*b*, and a fusible element 18. The dielectric substrate 12 may be a substantially planar, rectangular chip formed of a low surface energy, electrically insulating, thermally resistant material. Examples of such materials include, but are not limited to, glass, ceramic, FR-4, perfluoroalkoxy (PFA), ethylene tetrafluoroethylene (ETFE), or polyvinylidene fluoride (PVDF). The longitudinal edges of the dielectric substrate 12 may have semicircular castellations 20*a*, 20*b* formed therein. The present disclosure is not limited in this regard.

Figure 2:
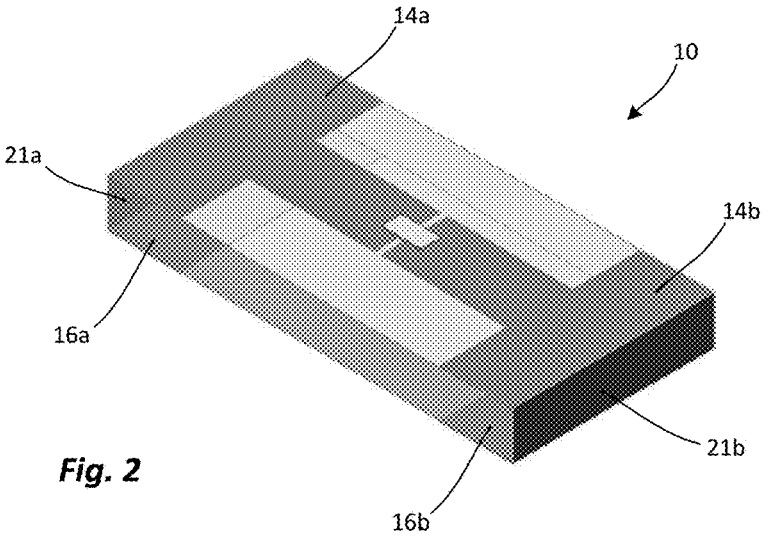
FIG. 2 is a perspective view illustrating a surface mount device chip fuse in accordance with another exemplary embodiment of the present disclosure.
Figure 3:
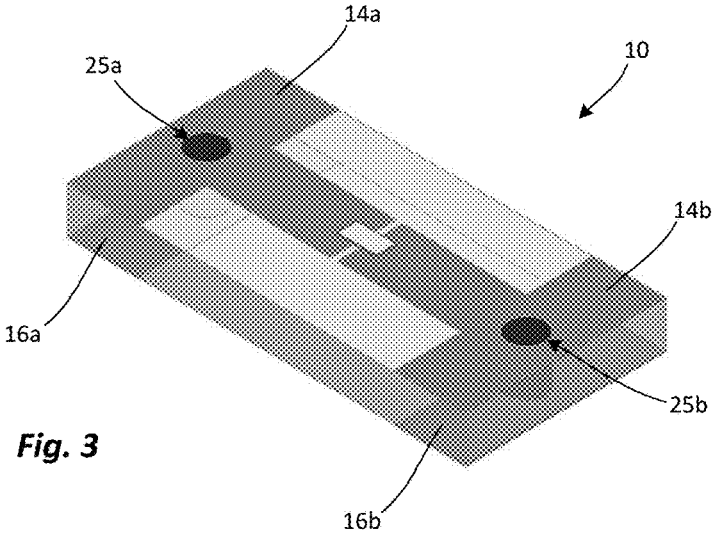
FIG. 3 is a perspective view illustrating a surface mount device chip fuse in accordance with another exemplary embodiment of the present disclosure.

The upper terminals 14*a*, 14*b* and lower terminals 16*a*, 16*b* may be disposed on top and bottom surfaces of the dielectric substrate 12, respectively, and may be formed of any suitable electrically conductive material, including, but not limited to, copper, gold, silver, nickel, tin, etc. The upper terminals 14*a*, 14*b* may extend from respective longitudinal edges of the dielectric substrate 12 toward one another and may terminate short of the longitudinal center of the top surface to define a gap 22 therebetween. The castellations 20*a*, 20*b* may be plated or otherwise coated with electrically conductive material (e.g., the same conductive material from which the terminals 14*a*, 14*b* and lower terminals 16*a*, 16*b* are formed) to provide electrical connections between the upper terminal 14*a* and the lower terminal 16*a* and between the upper terminal 14*b* and the lower terminal 16*b*, respectively. In an alternative embodiment of the SMD chip fuse 10 shown in FIG. 2, the castellations 20*a*, 20*b* may be omitted, and the substantially planer longitudinal edges 21*a*,

21*b* of the dielectric substrate 12 may be plated or otherwise coated with electrically conductive material to provide electrical connections between the upper terminal 14*a* and the lower terminal 16*a* and between the upper terminal 14*b* and the lower terminal 16*b*, respectively. In another alternative embodiment of the SMD chip fuse 10 shown in FIG. 3, electrically conductive vias 25*a*, 25*b* may extend through the dielectric substrate 12, between the upper terminal 14*a* and the lower terminal 16*a* and between the upper terminal 14*b* and the lower terminal 16*b*, respectively, for providing respective electrical connections therebetween. The present disclosure is not limited in this regard.

Referring back to FIG. 1, the fusible element 18 may be formed of a quantity of solder that is disposed on the top surface of the dielectric substrate 12 within the gap 22, bridging the upper terminals 14*a*, 14*b* to provide an electrical connection therebetween. The solder from which the fusible element 18 is formed may be selected such that, when the solder is in a melted or semi-melted state, the solder may have an aversion to, or a tendency to draw away from, the surface of the dielectric substrate 12. That is, the material of the dielectric substrate 12 may exhibit a significant "de-wetting" characteristic relative to the solder from which the fusible element 18 is formed. In one example, the dielectric substrate 12 may be formed of PFA and the solder may be SAC305 solder. In another example, the dielectric substrate 12 may be formed of ETFE and the solder may be eutectic solder. In another example, the dielectric substrate 12 may be formed of FR-4, PI (polyimide) and the solder may be a high melt solder (i.e., solder with a melting temperature above 260 degrees Celsius). The present disclosure is not limited in this regard.

During normal operation, the SMD chip fuse 10 may be connected in a circuit (e.g., the lower terminals 16*a*, 16*b* may be soldered to respective contacts on a printed circuit board) and current may flow through the lower terminals 16*a*, 16*b*, the upper terminals 14*a*, 14*b*, and the fusible element 18. Upon the occurrence of an overcurrent condition, wherein current flowing through the SMD chip fuse 10 exceeds a current rating of the SMD chip fuse 10, the fusible element 18 may melt or otherwise separate. The current flowing through the SMD chip fuse 10 is thereby arrested to prevent or mitigate damage to connected and surrounding circuit components.

Additionally, owning to the low surface energy and aversive, "de-wetting" characteristic of the dielectric substrate 12 relative to the melted or semi-melted solder of the fusible element 18 (described above), the separated portions of the fusible element 18 may draw away from one another and away from the surface of the dielectric substrate 12 and may accumulate on the confronting edges/portions of the upper terminals 14*a*, 14*b*, thereby ensuring galvanic opening in the SMD chip fuse 10 in response to an overcurrent condition. Electrical arcing between the separated portions of the fusible element 18 is thereby prevented or mitigated.

Figure 4:
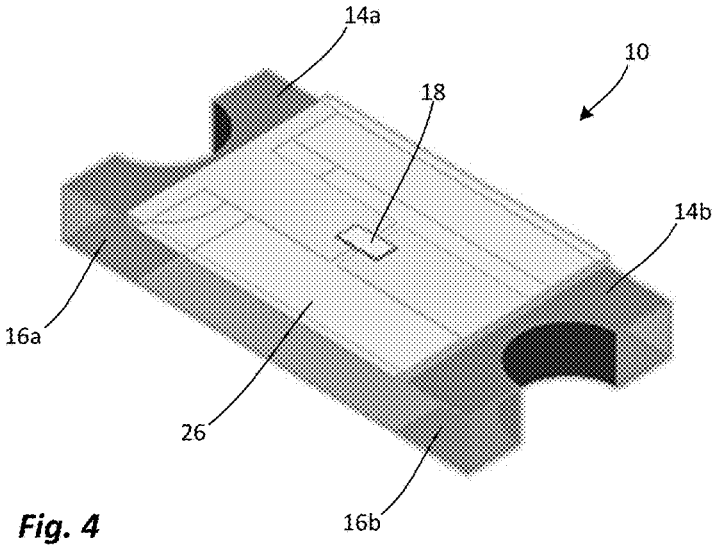
FIG. 4 is a perspective view illustrating a surface mount device chip fuse in accordance with another exemplary embodiment of the present disclosure.

Referring to FIG. 4, an alternative embodiment of the SMD chip fuse 10 is contemplated in which the fusible element 18 and adjacent portions of the upper terminals 14*a*, 14*b* may be covered with a dielectric passivation layer 26 for shielding the fusible element 18 from external contaminants and preventing short-circuiting with external circuit components. The passivation layer 26 may be formed of epoxy, polyimide, glass, ceramic, or other material that may exhibit a "de-wetting" characteristic relative to the solder from which the fusible element 18 is formed. Thus, when the fusible element 18 melts during an overcurrent condition in the SMD chip fuse 10, the aversive, "de-wetting" characteristic of the passivation layer 26 relative to the melted or semi-melted solder of the fusible element 18 may repel the separated portions of the fusible element 18 to further assist in galvanic separation therebetween.

Figure 5:
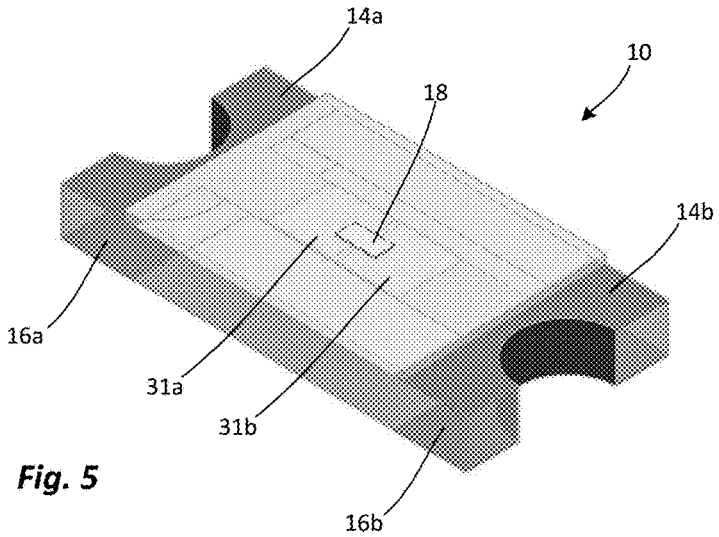
FIG. 5 is a perspective view illustrating a surface mount device chip fuse in accordance with another exemplary embodiment of the present disclosure.

Referring to FIG. 5, another alternative embodiment of the SMD chip fuse 10 is provided wherein top surfaces of the confronting portions of the upper terminals 14*a*, 14*b* are coated or plated with collection pads 31*a*, 31*b* formed of flux or a wetting agent that exhibits a significant affinity or "wetting" characteristic relative to the solder from which the fusible element 18 is formed. Examples of such materials include, but are not limited to, flux compounds made of rosin and/or polyglycol ether. Thus, when the fusible element 18 melts during an overcurrent condition in the SMD chip fuse 10, the melted, separated portions of the fusible element 18 may be drawn to, and may accumulate on, the collection pads 31*a*, 31*b* to further assist in galvanic separation between the upper terminals 14*a*, 14*b*.

Figure 6:
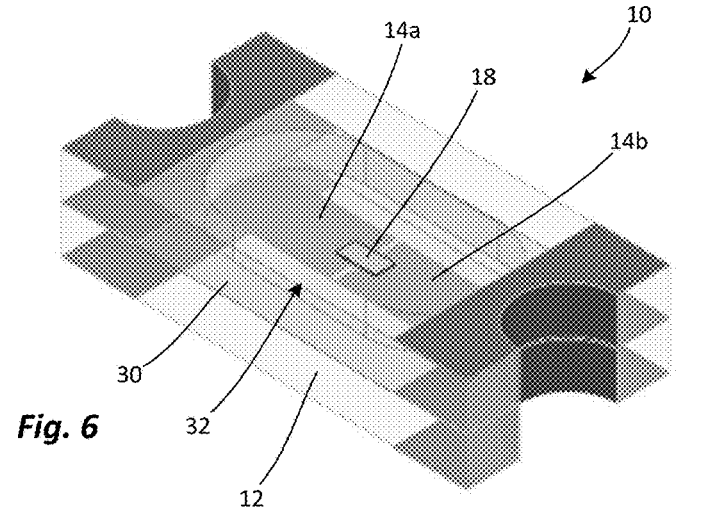
FIG. 6 is a perspective view illustrating a surface mount device chip fuse in accordance with another exemplary embodiment of the present disclosure.

Referring to FIG. 6, another alternative embodiment of the SMD chip fuse 10 is provided that includes a "non-contact" cover 30 disposed on the fusible element 18 and adjacent portions of the upper terminals 14*a*, 14*b* for shielding the fusible element 18 from external contaminants and preventing short-circuiting with external circuit components. The cover 30 may be substantially identical to the dielectric substrate 12 (e.g., formed from the same material and having the same size and shape as the dielectric substrate 12), but may include a cavity 32 formed in a bottom surface thereof. When the cover 30 is stacked atop the dielectric substrate 12 as shown, the fusible element 18 and adjacent portions of the upper terminals 14*a*, 14*b* may be disposed within the cavity 32.

Figure 7:
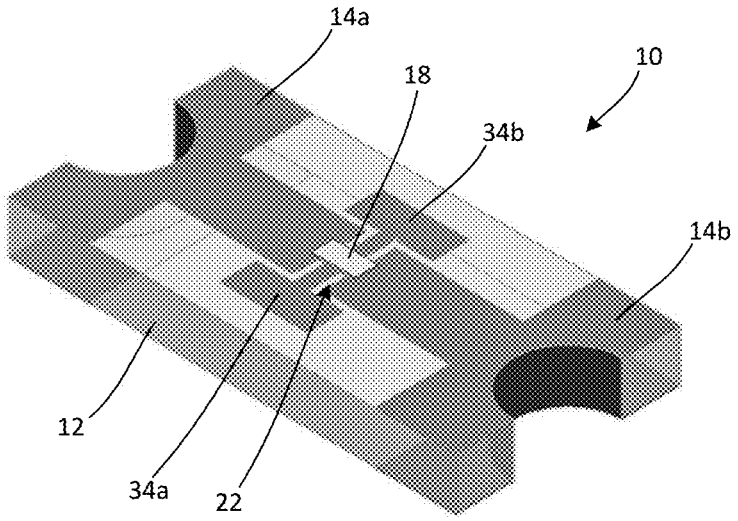
FIG. 7 is a perspective view illustrating a surface mount device chip fuse in accordance with another exemplary embodiment of the present disclosure.

Referring to FIG. 7, another alternative embodiment of the SMD chip fuse 10 is provided that includes electrically isolated metal pads 34*a*, 34*b* disposed atop the dielectric substrate 12 and extending into the gap 22, below the fusible element 18. When the fusible element 18 melts during an overcurrent condition in the SMD chip fuse 10, the metal pads 34*a*, 34*b* may provide additional surface area for collecting the melted solder of the fusible element 18 to clear the gap 22 and provide galvanic separation between the upper terminals 14*a*, 14*b*. The metal pads 34*a*, 34*b* may thus facilitate a high fuse rating and low electrical resistance in a small fuse package while also providing high insulation resistance after galvanic opening.

Figure 8:
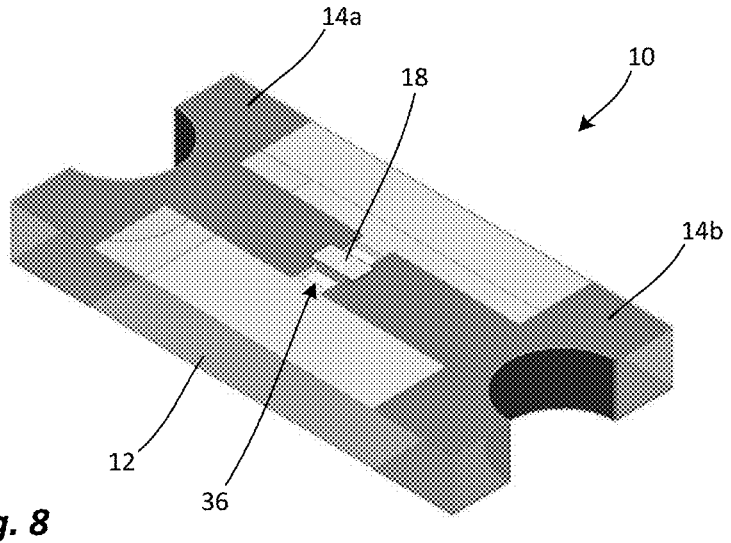
FIG. 8 is a perspective view illustrating a surface mount device chip fuse in accordance with another exemplary embodiment of the present disclosure.

Referring to FIG. 8, another alternative embodiment of the SMD chip fuse 10 is provided that includes a pocket or trench 36 formed in the dielectric substrate 12 below the fusible element 18. When the fusible element 18 melts during an overcurrent condition in the SMD chip fuse 10, the trench 36 may provide a space for collecting the melted solder of the fusible element 18 to clear the gap 22 and provide galvanic separation between the upper terminals 14*a*, 14*b*. The trench 36 may thus facilitate a high fuse rating and low electrical resistance in a small fuse package.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. A surface mount device chip fuse comprising:

a dielectric substrate;

electrically conductive first and second upper terminals disposed on a top surface of the dielectric substrate and defining a gap therebetween;

a fusible element formed of solder disposed on the top surface of the dielectric substrate, within the gap, bridging the first and second upper terminals;

electrically conductive first and second lower terminals disposed on a bottom surface of the dielectric substrate and electrically connected to the first and second upper terminals, respectively; and electrically isolated metal pads disposed on the top surface of the dielectric substrate and extending into the gap, below the fusible element;

wherein a material of the dielectric substrate exhibits a de-wetting characteristic relative to the solder from which the fusible element is formed.

2. The surface mount device chip fuse of claim 1, wherein edges of the dielectric substrate include electrically conductive material disposed thereon for providing electrical connections between the first upper terminal and the first lower terminal and between the second upper terminal and the second lower terminal.

3. The surface mount device chip fuse of claim 2, wherein edges of the dielectric substrate are castellated.

4. The surface mount device chip fuse of claim 1, further comprising electrically conductive vias extending through the dielectric substrate and providing electrical connections between the first upper terminal and the first lower terminal and between the second upper terminal and the second lower terminal.

5. The surface mount device chip fuse of claim 1, further comprising a passivation layer disposed on the fusible element and adjacent portions of the first and second upper terminals.

6. The surface mount device chip fuse of claim 1, further comprising collection pads disposed on confronting portions of the first and second upper terminals, the collection pads formed of a wetting agent that exhibits a significant wetting characteristic relative to the solder from which the fusible element is formed.

7. The surface mount device chip fuse of claim 1, further comprising a non-contact cover disposed on the top surface of the dielectric substrate, the non-contact cover being formed of a dielectric material and having a cavity formed in a bottom surface thereof, the fusible element being disposed within the cavity.

8. The surface mount device chip fuse of claim 1, further comprising a trench formed in the top surface of the dielectric substrate, below the fusible element.

* * * * *